US010446943B2

(12) United States Patent
Kondou et al.

(10) Patent No.: US 10,446,943 B2
(45) Date of Patent: Oct. 15, 2019

(54) CRIMPING TERMINAL

(75) Inventors: Takaya Kondou, Makinohara (JP); Masanori Onuma, Makinohara (JP); Yoshitaka Ito, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 636 days.

(21) Appl. No.: 14/003,604

(22) PCT Filed: Feb. 1, 2012

(86) PCT No.: PCT/JP2012/000674
§ 371 (c)(1),
(2), (4) Date: Sep. 23, 2013

(87) PCT Pub. No.: WO2012/120771
PCT Pub. Date: Sep. 13, 2012

(65) Prior Publication Data

US 2014/0004759 A1 Jan. 2, 2014

(30) Foreign Application Priority Data

Mar. 7, 2011 (JP) ..... 2011-048844

(51) Int. Cl.
*H01R 4/18* (2006.01)

(52) U.S. Cl.
CPC ..... *H01R 4/184* (2013.01); *H01R 4/185* (2013.01); *H01R 4/188* (2013.01)

(58) Field of Classification Search
CPC ..... H01R 4/184; H01R 4/185; H01R 4/188
(Continued)

(56) References Cited

U.S. PATENT DOCUMENTS 3,038,958 A 6/1962 Swengel
7,722,416 B2 * 5/2010 Gump ..... H01R 4/188 439/879
2011/0009014 A1 1/2011 Ono et al.

FOREIGN PATENT DOCUMENTS

CN 101740880 A 6/2010
EP 2290747 A1 3/2011
(Continued)

OTHER PUBLICATIONS

English translation of JP 2010-061870 A (original publication date Mar. 18, 2010).*
(Continued)

*Primary Examiner* — Amy Cohen Johnson
*Assistant Examiner* — Paul D Baillargeon
(74) *Attorney, Agent, or Firm* — Sughrue Mion, PLLC

(57) ABSTRACT

A crimping terminal comprises: a conductor crimping portion including a bottom plate and a pair of conductor crimping tabs, the conductor crimping tabs being extending from both sides of the bottom plate in a widthwise direction perpendicular to a lengthwise direction of the crimping terminal and being configured to crimp a conductor of an electrical cable so as to wrap the conductor, the conductor being formed by a bundle of wires and serving as a crimping subject disposed on the bottom plate along the lengthwise direction, the inner surface of the conductor crimping portion being provided with serrations including a plurality of uniformly cylindrical recesses with a diameter smaller than the diameter of the wire of the conductor, and wherein, in the plurality of recesses, the adjacent recesses deviated from each other in the widthwise direction of the crimping terminal partly overlap each other when seen from the lengthwise direction.

5 Claims, 6 Drawing Sheets

(58) Field of Classification Search
USPC ..... 439/877–879, 882
See application file for complete search history.

(56) References Cited

FOREIGN PATENT DOCUMENTS

| | | | | | |
|---|---|---|---|---|---|
| JP | 55-108192 | A | * | 8/1980 | ..... H01R 43/04 |
| JP | 2009-245695 | A | | 10/2009 | |
| JP | 2009259532 | A | | 11/2009 | |
| JP | 2010-3467 | A | | 1/2010 | |
| JP | 2010-061870 | A | | 3/2010 | |
| JP | 2010244878 | A | | 10/2010 | |
| JP | 2010244883 | A | | 10/2010 | |
| WO | 2009/128344 | A1 | | 10/2009 | |
| WO | 2012/017736 | A1 | | 2/2012 | |

OTHER PUBLICATIONS

International Search Report for PCT/JP2012/000674, dated May 31, 2012.
Communication dated Feb. 28, 2015 from the State Intellectual Property Office of People's Republic of China in counterpart Application No. 201280011774.3.
Communication dated Dec. 17, 2014 from The Korean Intellectual Property Office in counterpart Korean Patent Application No. 10-2013-7026246.
Communication dated Nov. 25, 2014 from the Japanese Patent Office in counterpart application No. 2011-048844.
Communication dated Sep. 30, 2015 from the State Intellectual Property Office of People's Republic of China in counterpart Application No. 201280011774.3.
Communication dated Jun. 3, 2015 from the European Patent Office in counterpart application No. 12714073.9.
Communication dated Aug. 1, 2016, from the European Patent Office in counterpart European Application No. 12714073.9.
Communication dated Mar. 13, 2018 from the Intellectual Property India in counterpart application No. 7302/CHENP/2013.
Communication dated Mar. 29, 2017 from the European Patent Office in counterpart Application No. 12 714 073.9.

* cited by examiner

[Fig. 1]
PRIOR ART
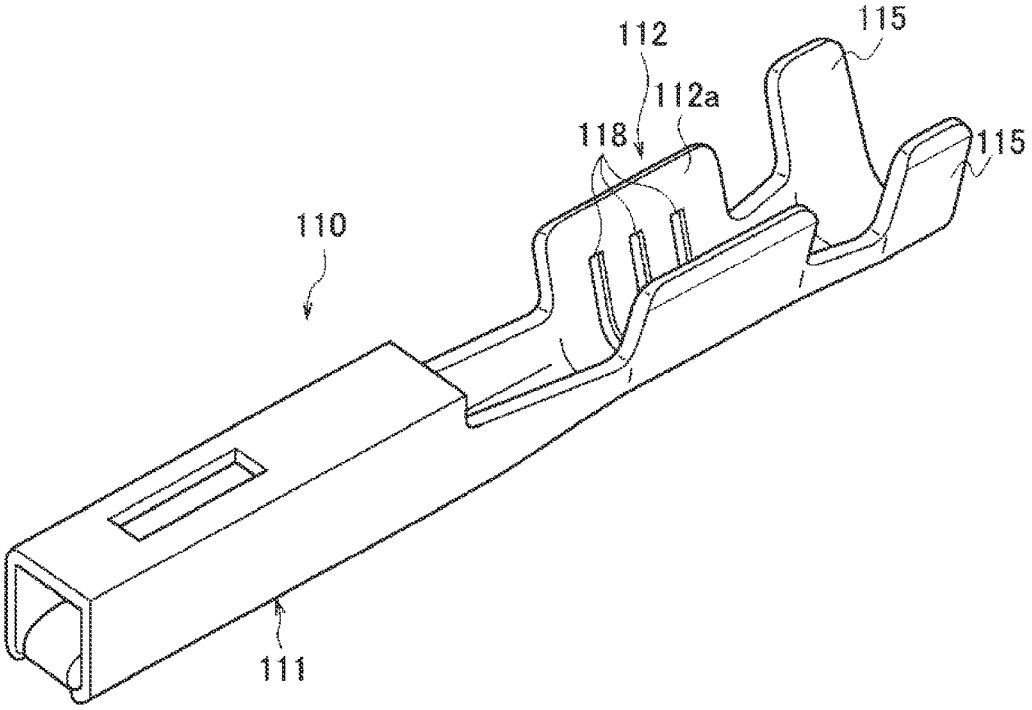

[Fig. 2]
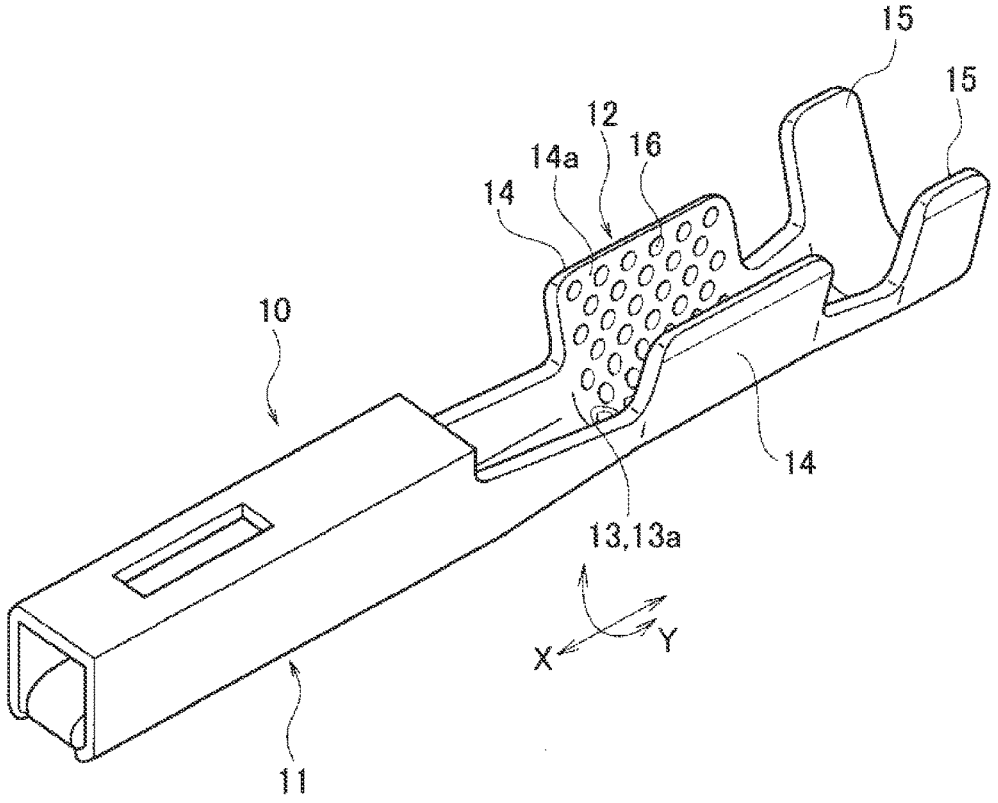

[Fig. 3]
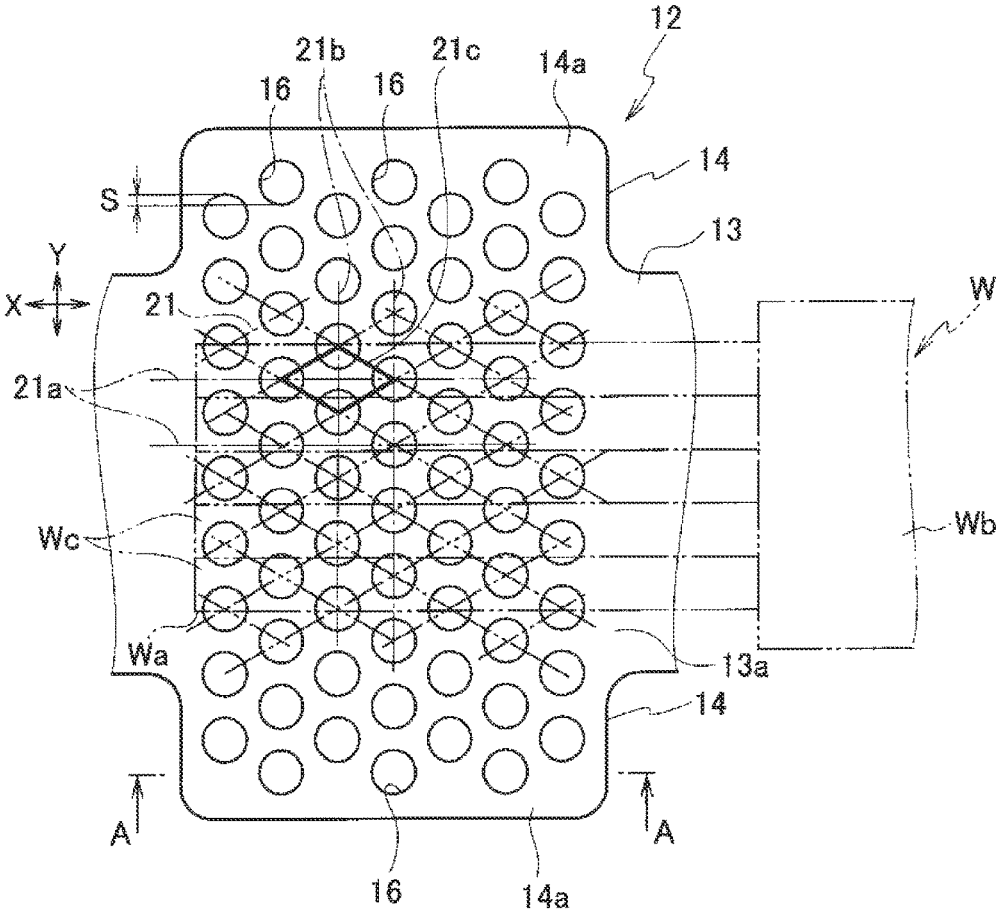
[Fig. 4]
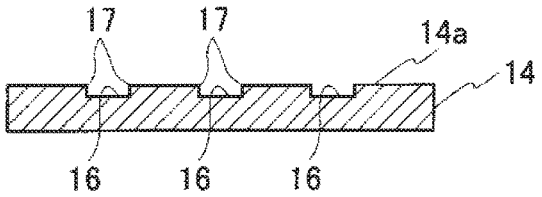

[Fig. 5]
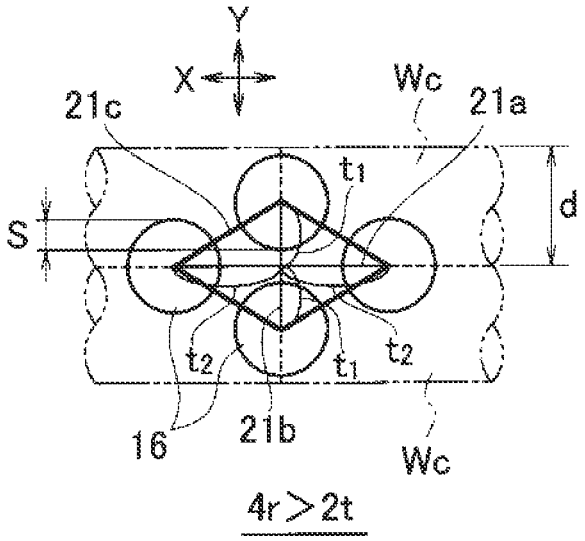
[Fig. 6]
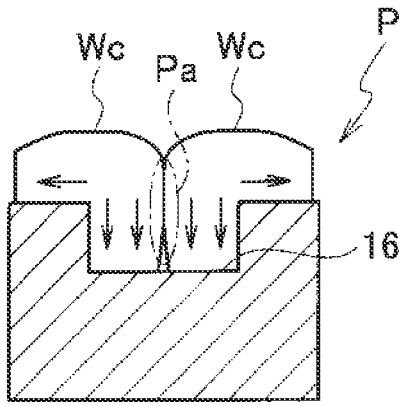

[Fig. 7]
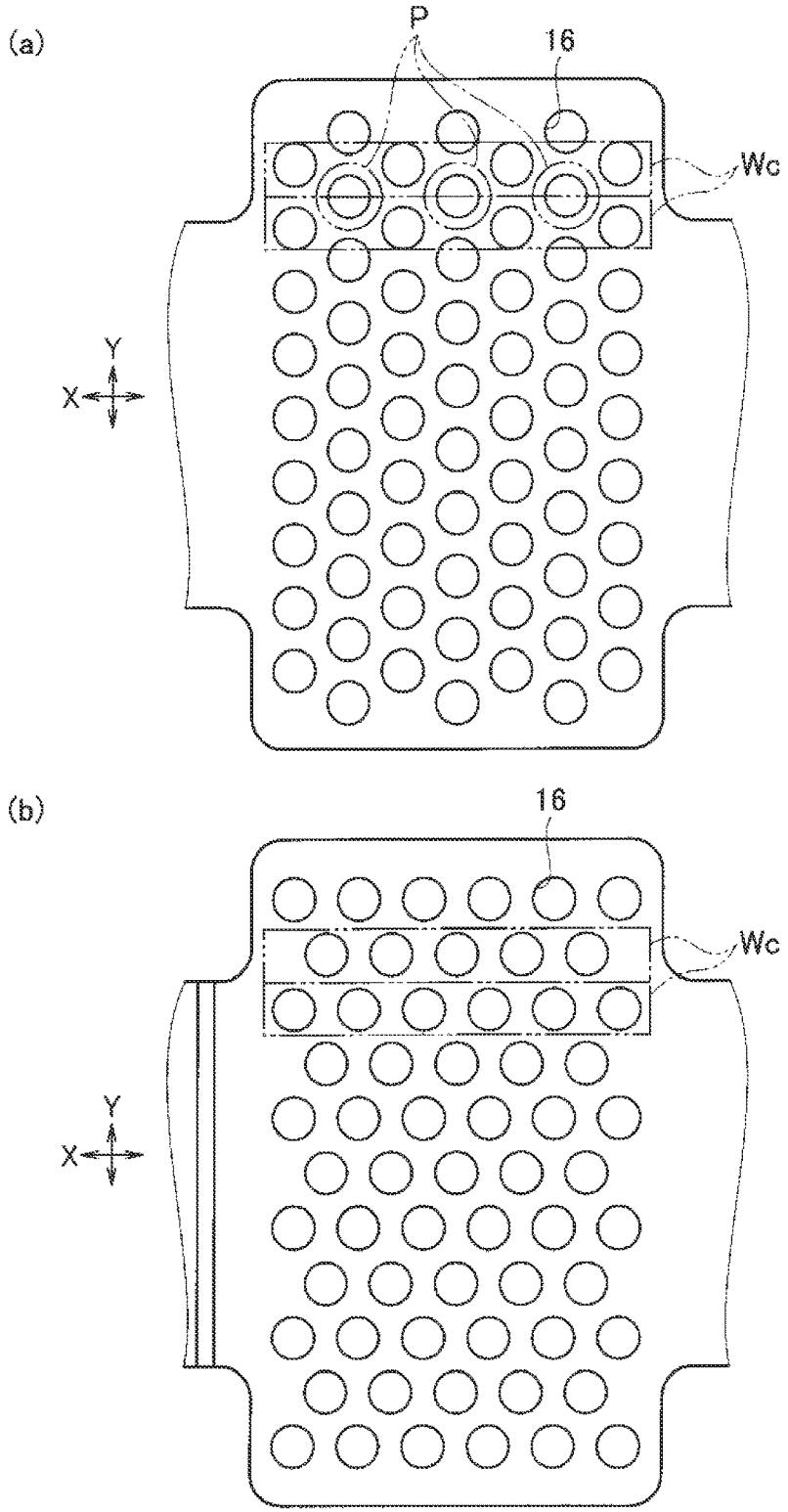

[Fig. 8]
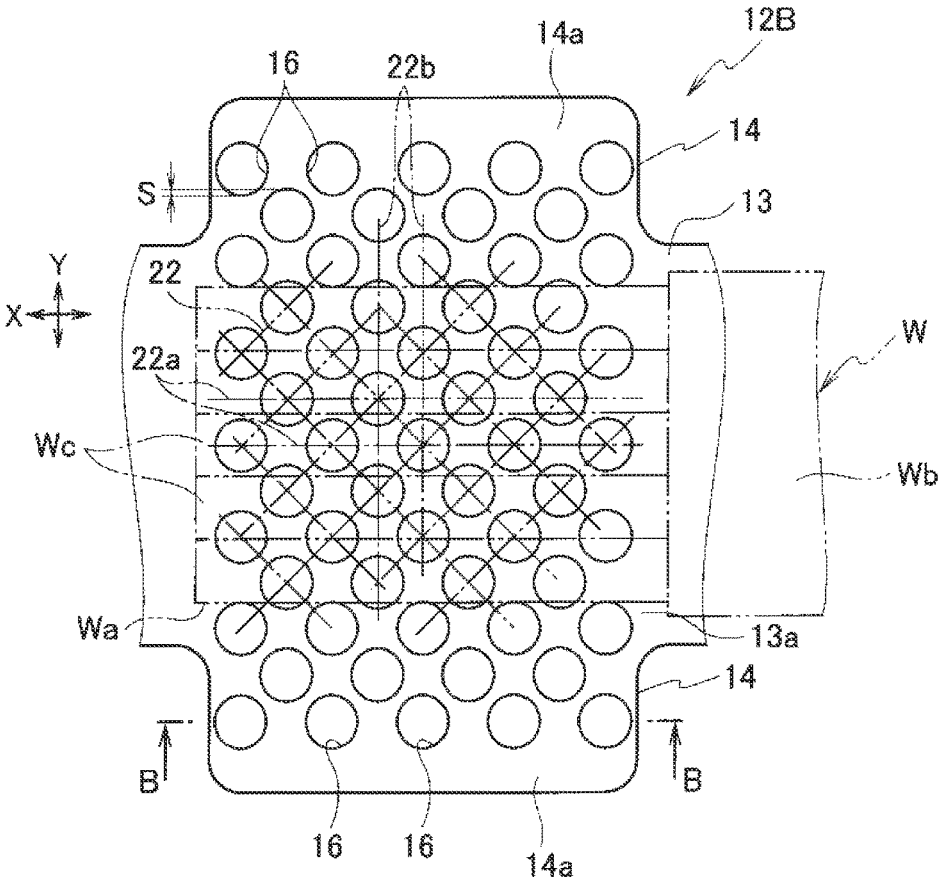
[Fig. 9]
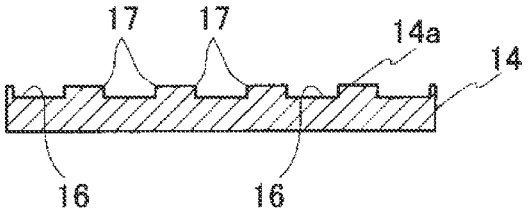

CRIMPING TERMINAL

TECHNICAL FIELD

The present invention relates to a crimping terminal that is suitably connected to an electric cable.

BACKGROUND ART

FIG. 1 illustrates a crimping terminal 110 which is disclosed in Patent Literature 1. The crimping terminal 110 includes: an electrical connection portion 111 which is electrically connected to a counter terminal (not illustrated); a conductor crimping portion 112 which has a substantially U-shaped cross-section and crimps a conductor (a core) formed by twisting plural wires (electric cables); and a sheath crimping portion 115 which is fixed to the sheath portion of the electric cable. A serration 118 with three grooves is formed in an inner surface 112*a* of the conductor crimping portion 112. These grooves extend in a direction perpendicular to the lengthwise direction of the conductor.

When the conductor crimping portion 112 of the crimping terminal 110 crimps the conductor of the electric cable, the wire of the conductor is press-inserted into the groove-like serration 118 while being deformed. At this time, a serration edge which is an edge of the serration 118 tears an oxide coating of the surface of the wire of the conductor, so that a newly-formed surface is formed. As a result, the newly-formed surface comes into close contact with the conductor crimping portion 112 of the crimping terminal 110, so that the crimping terminal 110 and the electric cable are electrically connected to each other.

CITATION LIST

Patent Literature

[PLT 1]
Japanese Patent Application Laid-Open No. 2009-245695

SUMMARY OF INVENTION

Technical Problem

In the above-described crimping terminal 110, all characteristics such as electrical connection strength and mechanical connection strength become largely irregular after the conductor crimping portion 112 crimps the conductor of the electric cable. For example, when the crimping force is not sufficient (that is, the compressibility of the conductor crimping portion 112 or the conductor is too low), the newly-formed surface is not sufficiently formed and the electrical connection resistance increases due to the oxide coating which remains in the crimping terminal 110 and the electric cable. Thus, the electrical connection becomes unstable. Further, when the crimping force is too strong (the compressibility is too high), the damage with respect to the conductor is large and the mechanical connection strength (the fixation strength) between the crimping terminal 110 and the electric cable decreases. Especially when the conductor is formed by twisting and binding thin wires, the conductor is likely to be affected by this damage.

The invention has been made in view of the above-described circumstances, and it is an object of the invention to provide a crimping terminal capable of stably maintaining low electrical connection resistance and high mechanical connection strength.

Solution to Problem

An aspect of the invention is a crimping terminal comprising: a conductor crimping portion including a bottom plate and a pair of conductor crimping tabs. The conductor crimping tabs is formed extending from both sides of the bottom plate in a widthwise direction perpendicular to a lengthwise direction of the crimping terminal and is configured to crimp a conductor of an electrical cable so as to wrap the conductor. Here, the conductor is formed by a bundle of wires and serves as a crimping subject disposed on the bottom plate along the lengthwise direction. The inner surface of the conductor crimping portion is provided with serrations including a plurality of uniformly cylindrical recesses with a diameter smaller than the diameter of the wire of the conductor. In the plurality of recesses, the adjacent recesses deviated from each other in the widthwise direction of the crimping terminal partly overlap each other when seen from the lengthwise direction.

When it is assumed that a grid is formed so as to obliquely intersect with the lengthwise direction of the crimping terminal, the recesses may be disposed at grid points of the grid, and the recesses may be arrayed in the lengthwise direction of the crimping terminal while being staggered in the widthwise direction of the crimping terminal.

The recesses of the serrations may be arrayed in the lengthwise direction of the crimping terminal while being staggered by a half of a pitch in the widthwise direction of the crimping terminal, and the pitch may be a distance with respect to the adjacent one of the recesses arranged in the lengthwise direction of the crimping terminal.

The grid may include a quadrilateral unit frame with a first diagonal line along the lengthwise direction of the crimping terminal and a second diagonal line perpendicular to the first diagonal line, and the first diagonal line may be longer than the second diagonal line.

The grid may include a quadrilateral unit frame with a first diagonal line along the lengthwise direction of the crimping terminal and a second diagonal line perpendicular to the first diagonal line.

The length of the first diagonal line may be equal to the length of the second diagonal line.

Advantageous Effects of Invention

According to the invention, it is possible to provide a crimping terminal capable of stably maintaining low electrical connection resistance and high mechanical connection strength.

BRIEF DESCRIPTION OF DRAWINGS

FIG. 1 is a perspective view illustrating a conventional crimping terminal.

FIG. 2 is a perspective view illustrating a crimping terminal of a first embodiment of the invention.

FIG. 3 is a main exploded diagram illustrating a conductor crimping portion of the crimping terminal of the first embodiment.

FIG. 4 is a cross-sectional view taken along the line A-A of FIG. 3.

FIG. 5 is an enlarged diagram illustrating a positional relation between a serration (a cylindrical recess) formed in the conductor crimping portion of the crimping terminal of the first embodiment and a wire of an electric cable.

FIG. 6 is an enlarged cross-sectional view illustrating a state where two wires enter into the serration by the crimping operation.

FIG. 7 is a diagram illustrating a relation between the wire and the array of the serration formed in the inner surface of the conductor crimping portion, where FIG. 7(*a*) is a main exploded diagram illustrating the inner surface of the conductor crimping portion according to an embodiment of the invention and FIG. 7(*b*) is a main exploded diagram illustrating the inner surface of the conductor crimping portion as a comparative example of the embodiment.

FIG. 8 is a main exploded diagram illustrating a conductor crimping portion of a crimping terminal of a second embodiment of the invention.

FIG. 9 is a cross-sectional view taken along the line B-B of FIG. 8.

DESCRIPTION OF EMBODIMENTS

Hereinafter, embodiments of the invention will be described by referring to the drawings.

As illustrated in FIG. 2, a crimping terminal 10 of the embodiment is produced by pressing an aluminum or aluminum-alloy sheet or a copper or copper-alloy sheet subjected to tin plating. The crimping terminal 10 includes: an electrical connection portion 11 which is provided at the front end side thereof; a conductor crimping portion 12 which is provided at the rear side of the electrical connection portion 11 so as to have a substantially U-shaped cross-section; and a sheath crimping portion 15 which is provided at the rear side of the conductor crimping portion 12 so as to have a substantially U-shaped cross-section. The electrical connection portion 11 is electrically connected to the counter terminal. The conductor crimping portion 12 is wound on the outer periphery of a terminal of a conductor Wa of an electric cable W so as to crimp the terminal, so that it is electrically connected to the conductor Wa. The sheath crimping portion 15 is wound on the outer periphery of a sheath Wb of the electric cable W so as to crimp the sheath.

As illustrated in FIG. 3, the electric cable W includes the conductor (a core) Wa which is formed by twisting plural wires We and the insulating sheath Wb which covers the conductor Wa. The crimping terminal 10 is connected to the terminal (the front end) of the conductor Wa of the electric cable W so that the front-rear direction thereof matches the lengthwise direction of the conductor Wa of the electric cable W.

Here, a description will be made on the assumption that the front-rear direction of the crimping terminal 10, that is, the terminal lengthwise direction is set as the X direction and the terminal widthwise direction perpendicular thereto and the circumferential direction of the conductor Wa are set as the Y direction.

The conductor crimping portion 12 is formed so as to have a substantially U-shaped cross-section by including a bottom plate 13 which is continuous from the electrical connection portion 11 and a pair of left and right conductor crimping tabs 14 and 14 which extends from both left and right sides of the bottom plate 13 (both sides in the Y direction) and crimps the conductor Wa disposed on an inner surface 13*a* of the bottom plate 13 so as to enclose the conductor.

In the inner surface of the conductor crimping portion 12, that is, the range from the inner surface 13*a* of the bottom plate 13 to the inner surface 14*a* of the conductor crimping tab 14, plural recesses 16 which serve as serrations are provided so as to be spaced from each other. The respective recesses 16 are formed in, for example, a cylindrical shape and have the same shape. That is, all recesses 16 have the same depth and the same diameter (the same radius r). The diameter (that is, 2r) of each recess 16 is smaller than the diameter d of the wire We of the electric cable W.

The above-described recess 16 is provided as illustrated in FIG. 3. That is, when it is assumed that a grid 21 is formed in the inner surface of the conductor crimping portion 12 as depicted by the two-dotted chain line of FIG. 3, the recess 16 is disposed at the grid point (the intersection point) of the grid 21. The grid 21 obliquely intersects with the X direction. Further, the grids 21 are distributed so as to be line-symmetrical to each other in the Y direction. Hence, the recesses 16 are staggered in the Y direction along the X direction.

A unit frame (a unit grid) 21*c* which forms the grid 21 includes a first diagonal line 21*a* (with a length $2t_2$) and a second diagonal line 21*b* (with a length $2t_1$). The first diagonal line 21*a* (and the extension line thereof) is positioned along the X direction, and the second diagonal line 21*b* (and the extension line thereof) is positioned along the Y direction. Further, the first diagonal line 21*a* and the second diagonal line 21*b* intersect with each other at the center thereof. Furthermore, the first diagonal line 21*a* is longer than the second diagonal line 21*b*. That is, the unit frame 21*c* has an argyle shape which is long in the X direction. As illustrated in FIGS. 3 and 5, the recesses 16 are linearly arrayed in the Y direction at the same pitch (with a length $2t_1$). The recesses 16 which are adjacently arrayed in the X direction are deviated from each other by a half pitch (that is, a length $t_1$) in the Y direction. In other words, the recesses 16 of the serrations are arrayed along the X direction, and the recesses 16 which are adjacent in the X direction are staggered in the Y direction by a half (a length $t_1$) of a pitch (a length $2t_1$) as a distance between the recesses 16 in the X direction.

In the adjacent arrays of plural arrays of the recesses 16 along the Y direction, the recesses 16 of the respective arrays which are deviated from each other in position in the Y direction partially overlap each other when seen from the X direction. That is, the length S of the overlapping position is in the range of 0 to the diameter (2r) of the recess 16 (that is, $0<S<2r$).

A conductor Wa which is exposed by removing a sheath in the terminal of the electric cable W is placed on the bottom plate 13 of the conductor crimping portion 12. When the pair of conductor crimping tabs 14 and 14 crimps the conductor Wa so as to enclose the conductor, the inner surface of the conductor crimping portion 12 strongly comes into press-contact with the conductor Wa by the external pressure. At this time, apart of the conductor Wa extends between the recesses 16 as the serrations in the lengthwise direction, and a part of the conductor Wa is press-inserted into the recesses 16.

When a part of the conductor Wa is press-inserted into the recess (the serration) 16, an opening edge (hereinafter, referred to as a serration edge) 17 tears an oxide coating of the surface of the conductor Wa, so that a newly-formed surface is exposed. As a result, the newly-formed surface comes into close contact with the inner surface of the recess 16, so that the electrical connection resistance decreases. Further, since the conductor Wa is press-inserted into the recess 16, the conductor Wa is caught by the serration edge 17, so that the mechanical connection strength increases. That is, the conductor Wa does not easily come off from the crimping terminal 10.

As described above, the diameter (2r) of the recess 16 is smaller than the diameter d of the wire We which forms the conductor (the core) Wa of the electric cable W. Since the recesses 16 are provided so as to be scattered, the total length of the serration edge 17 of the recess 16 can be ensured to be sufficiently long. Thus, when the conductor crimping portion 12 crimps the conductor Wa of the electric cable, the oxide coating of the surface of the conductor Wa is torn by the serration edge 17 with a long total length, so that a large newly-formed surface can be formed. Thus, it is possible to increase an area where the conductor Wa comes into close contact with the crimping terminal 10, and is possible to stably maintain the low electrical connection resistance.

Further, since the diameter (2r) of the scattered recesses 16 is smaller than the diameter d of the wire Wc, it is possible to disperse damage to each wire Wc during the crimping operation (that is, the compressibility of the conductor crimping portion 12 or the conductor Wa). Thus, high mechanical connection strength can be stably maintained.

Further, the recesses 16 which are closest to each other in the X direction are deviated from each other in the Y direction, and overlap each other by the dimension S when seen from the X direction. In other words, the recesses 16 are arrayed at the respective grid points of the grid 21 which are virtually set in the inner surface of the conductor crimping portion 12, and the positions thereof in the Y direction partly overlap each other by the dimension S between the recesses 16 which are deviated from each other by a half pitch $t_1$ in the Y direction between the adjacent arrays in the X direction. Thus, as illustrated in FIGS. 5, 6, and 7(*a*), in a region where the plural recesses 16 are formed, a region P where two wires Wc simultaneously enter into one recess 16 is inevitably present. In this region P, contact between the newly-formed surfaces Pa of both wires Wc is promoted by the stretching of the wire Wc generated when the wire Wc enters into the recess 16 (as depicted by the arrow of FIG. 6). In particular, when the wire Wc is made of aluminum or aluminum alloy, since the adhesion between the newly-formed surfaces is promoted, the stable electrical performance can be obtained.

Further, in two diagonal lines 21*a* and 21*b* of the unit frame 21*c* of the grid 21, the diagonal line 21*a* along the X direction is longer than the diagonal line 21*b* along the Y direction. Thus, even when the recess 16 is comparatively small, the respective recesses 16 in the adjacent arrays in the Y direction is easily formed so as to overlap each other when seen from the X direction. Further, since the gap between the recesses (the serrations) 16 in the circumferential direction (the Y direction) of the conductor Wa is relatively small, it is possible to increase the area of the newly-formed surface which is formed by the serration edge 17, and is possible to stably maintain the low electrical connection resistance between the conductor Wa and the terminal 10. Further, since the gap between the recesses (the serrations) 16 in the X direction is relatively wide, it is possible to disperse damage to each wire Wc.

In addition, as in the comparative example of FIG. 7(*b*), if there are no recesses which partly overlap each other in the Y direction between the recesses 16 deviated from each other in position along the Y direction, two wires Wc may not simultaneously enter into one recess 16. In this case, the contact (or the adhesion) between the newly-formed surfaces Pa formed in both wires Wc is not easily promoted.

Furthermore, when the diameter (2r) of the recess 16 is set to be larger than the diameter d of the wire Wc, plural wires Wc easily enter into the recess 16. However, since the number of the recesses 16 arrayed in a determined area (unit area) decreases, the total length of the serration edge 17 is shortened. Thus, this is disadvantageous from the viewpoint of forming the newly-formed surface. On the contrary, as in the embodiment, when the diameter 2r of the cylindrical recess is set to be smaller than the diameter d of the wire Wc, it is possible to increase the number of the recesses 16 arrayed in a determined area. For this reason, the total length of the serration edge 17 can be lengthened, and the newly-formed surface can be more easily formed.

Furthermore, it is desirable to set the interval of the grid 21 and the hole diameter and the depth of the recess 16 as the serration depending on the material, the wire diameter, and the number of the wires Wc forming the conductor Wa.

Next, a second embodiment will be described by referring to the drawings. The same reference signs will be given to the same components as those of the first embodiment, and the detailed description thereof will not be repeated. This embodiment is different from the first embodiment in that the array pattern of the recesses 16 as the serrations formed in the inner surface of the conductor crimping portion 12B corresponding to the conductor crimping portion 12 of the first embodiment is different.

As illustrated in FIG. 8, in the conductor crimping portion 12B of the embodiment, when it is assumed that a grid 22 is formed by the recess 16 disposed at each grid point (the intersection point), the grid 22 obliquely intersects with the X direction as in the grid 21 described in the first embodiment. Further, the grid 22 includes plural unit frames 22*c* with a diagonal line 22*a* along the X direction of a unit frame 22*c* and a diagonal line 22*b* along the Y direction. In the embodiment, the length of the diagonal line 22*a* is equal to the length of the diagonal line 22*b*. That is, the unit frame 22*c* of the grid 22 has a square shape.

The process in which the conductor crimping portion 12 crimps the terminal of the electric cable W is the same as that of the first embodiment.

In this way, when the length of the diagonal line 22*a* is equal to the length of the diagonal line 22*b*, the stable reduction in the electrical connection resistance and the stable reinforcement in the mechanical connection strength can be obtained with a good balance.

Furthermore, in the first embodiment, a case has been described in which the diagonal line 21*a* along the X direction is longer than the diagonal line 22*b* along the Y direction. However, the diagonal line 21*a* may be shorter than the diagonal line 22*b*.

Further, in the respective embodiments, a case has been described in which the grids 21 and 22 virtually set in the inner surface of the conductor crimping portion 12 are line-symmetrical to each other in the Y direction. However, the grid according to the invention is not limited to the line-symmetrical distribution in the Y direction.

That is, with regard to the plural recesses 16 which serve as the serrations formed in the inner surface of the conductor crimping portion 12, two recesses arrayed in the X direction may be deviated from each other and partly overlap each other in the Y direction when seen from the X direction. The recesses (the serrations) which satisfy this condition may bring the above-described effect. For example, the length of the diagonal line 21*a* (22*a*) or the diagonal line 21*b* (22*b*) of each unit frame 21*c* (22*c*) of the above-described grid 21 (22) may be changed as long as the above-described condition is satisfied.

INDUSTRIAL APPLICABILITY

The invention can provide a crimping terminal capable of stably maintaining low electrical connection resistance and high mechanical connection strength.

The invention claimed is:

1. A crimping terminal comprising:

a conductor crimping portion including a bottom plate and a pair of conductor crimping tabs, the conductor crimping tabs being formed extending from both sides of the bottom plate in a widthwise direction perpendicular to a lengthwise direction of the crimping terminal and being configured to crimp a conductor of an electrical cable so as to wrap the conductor, the conductor being formed by a bundle of wires and serving as a crimping subject disposed on the bottom plate along the lengthwise direction, an inner surface of the conductor crimping portion being provided with serrations including a plurality of uniformly cylindrical recesses, with a diameter smaller than a diameter of the wire of the conductor, wherein, in the plurality of recesses, adjacent recesses deviated from each other in the widthwise direction of the crimping terminal partly overlap each other when seen from the lengthwise direction, wherein, in the plurality of recesses, adjacent recesses deviated from each other in the lengthwise direction of the crimping terminal partly overlap each other when seen from the widthwise direction.

2. The crimping terminal according to claim 1, wherein the recesses are disposed at grid points of a grid that obliquely intersects with the lengthwise direction of the crimping terminal, and the recesses are arrayed in the lengthwise direction of the crimping terminal while being staggered in the widthwise direction of the crimping terminal.

3. The crimping terminal according to claim 2, wherein the recesses of the serration are arrayed in the lengthwise direction of the crimping terminal with being staggered by a half of a pitch in the width direction thereof, and the pitch is a distance with respect to adjacent one of the recesses arranged in the width direction of the crimping terminal.

4. The crimping terminal according to claim 3, wherein the grid includes a quadrilateral unit frame with a first diagonal line along the lengthwise direction of the crimping terminal and a second diagonal line perpendicular to the first diagonal line, and the first diagonal line is longer than the second diagonal line.

5. The crimping terminal according to claim 3, wherein the grid includes a quadrilateral unit frame with a first diagonal line along the lengthwise direction of the crimping terminal and a second diagonal line perpendicular to the first diagonal line, and a length of the first diagonal line is equal to a length of the second diagonal line.

* * * * *